United States Patent [19]

Brouwer et al.

[11] 4,226,379

[45] Oct. 7, 1980

[54] LOOM STORAGE FEEDER IMPROVEMENT

[75] Inventors: Charles W. Brouwer, E. Greenwich; Rene J. Valois, Woonsocket, both of R.I.

[73] Assignee: Leesona Corporation, Warwick, R.I.

[21] Appl. No.: 100,984

[22] Filed: Dec. 6, 1979

Related U.S. Application Data

[63] Continuation-in-part of Ser. No. 952,501, Oct. 18, 1978, abandoned.

[51] Int. Cl.[3] ..... B65H 51/20

[52] U.S. Cl. ..... 242/47.01; 139/452

[58] Field of Search ..... 242/47.01, 47.12, 47.13, 242/45; 66/132 R; 139/452; 318/327, 345 C, 345 CA

[56] References Cited

U.S. PATENT DOCUMENTS

| | | | |
|---|---|---|---|
| 1,353,815 | 9/1920 | Meyer | 318/327 |
| 3,181,050 | 4/1965 | Berman | 318/345 CA X |
| 3,276,484 | 10/1966 | Bucher | 139/452 |
| 3,575,216 | 4/1971 | Strauss | 139/452 X |
| 3,674,057 | 7/1972 | Hosono et al. | 139/452 |
| 3,796,385 | 3/1974 | Jacobsson | 242/47.01 |
| 3,796,386 | 3/1974 | Tannert | 242/47.01 X |
| 3,843,914 | 10/1974 | Carlson et al. | 318/327 |
| 3,915,365 | 10/1975 | Lace | 318/327 X |

*Primary Examiner*—Stanley N. Gilreath
*Attorney, Agent, or Firm*—Burnett W. Norton

[57] ABSTRACT

The disclosure relates to a system and method for correlating strand withdrawal speed from a strand supply package and utility means such as a shuttleless loom thereby reducing the possibility of supply package sloughs and strand breakage caused by conditions such as large changes in loading on an intermediate stationary drum type strand feeding and storage device. Thus, the loom operates to withdraw strand from the feeding device at a first average rate. A flyer withdraws strand from the supply package at a second rate which is slightly higher than the first average rate and wraps that strand onto the drum of the feeding device. Withdrawal of the strand by the flyer generates a balloon in the strand intermediate the strand supply and the flyer. Flyer drive speed is controlled by a feedback system which avoids changes in speed of the flyer except when occurrences of an overfill of strand on the drum occur. An overfill detector is provided for the drum and operates an on-off circuit in response to detection of an over-accumulation of strand on the drum to interrupt current flow to the flyer drive. When the overfill condition is relieved current is restored to the flyer drive. The frequency and duration of current interruptions is controlled so that the balloon of strand between the strand supply and the flyer is maintained at all times when the loom is operating. Consequently, strand sloughs and strand breakage which could result from frequent starts and stops of the feeding device are avoided. The system and method are equally applicable to strand feeding devices of the rotary drum type, in which case the motor is employed to control drum drive speed.

9 Claims, 2 Drawing Figures

LOOM STORAGE FEEDER IMPROVEMENT

CROSS-REFERENCE TO RELATED APPLICATION

This application is a continuation-in-part of co-pending U.S. Pat. Ser. No. 952,501, filed Oct. 18, 1978, now abandoned.

BACKGROUND OF THE INVENTION a. Field of the Invention

This invention relates to systems and methods for feeding strand under controlled conditions from a supply to utility means such as a shuttleless loom and, more specifically, it relates to strand feeding means producing an interface between a supply of strand and utility means consuming said strand.

b. Discussion of the Prior Art

In the classical shuttle loom the weft strand is inserted in the loom shed by the filling bobbin itself carried by the shuttle. The unwinding process takes place simultaneously with the passage of the bobbin through the shed, so that no specific tension problems are encountered.

Shuttleless looms incorporate new and quite radical changes in the weft insertion system. For example, since the weft strand is stationary and outside the loom, withdrawal of the strand from the supply with each pick of the loom involves alternating acceleration and deceleration of that strand. The acceleration rate is, of course, a direct reflection of the loom withdrawal process. During acceleration and deceleration the balloon created as the strand is pulled off in over-end fashion from the supply package is alternately established and collapsed. As a consequence, and in the absence suitable intermediate strand storage means, high tensions are created in the weft strand being withdrawn from its stationary supply during the acceleration phase of each pick. Such high tensions can cause sloughing and/or breakage of the weft strand being withdrawn from the supply. Moreover, loom stops can occur, and kinks can be produced in the fabric, all of which lead to reduced loom efficiency and reduced fabric quality.

Accordingly, because of the necessity to feed strand reliably from supplies at high speed into shuttleless looms and the like which operate intermittently to consume strand increments during the picking motion as just described, drum type strand storage and feeding devices are used in an attempt to reduce snarls and breakage of strand and to level tensions caused by intermittent withdrawal of strand from a supply by the loom weft insertion system. One example of such yarn storage and feeding devices is U.S. Pat. No. 3,776,480 issued to John B. Lawson on Dec. 4, 1973, which is incorporated herein as a typical background reference showing the devices and their mode of operation. These prior art storage feeders have as their objective a constant tension strand feed from the drum of the storage feeder to the strand consuming utility means.

It has also been known in the prior art to sense the store of strand on the intermediate drum of the feeder and to change the drum rotation speed by braking the drum speed whenever the store of strand becomes excessive. This technique is typified by U.S. Pat. No. 3,225,446 issued to A. G. Sarfati et al, on Dec. 28, 1965, which clutches a multiple ratio differential for accelerating and decelerating the drum speed is response to detection of a corresponding decrease or increase of strand stored thereon. Another example of such speed control is U.S. Pat. No. 3,796,385 issued to K. A. G. Jacobsson on Mar. 12, 1974, which uses a pivoting mechanical strand supply sensor and corresponding electrical contact swtich for varying the drum speed by switching on and off the a-c motor drive circuit. The drum loading and, therefore, speed can change drastically. Speed variation has been measured as much as 70% from change of friction between cold start and stable temperature conditions. Also, package tensions have been measured to vary several hundred grams. Therefore, in an effort to meet this problem it has been customary in the prior art to operate the strand storage feeder units at speeds substantially in excess of the weft consuming speed. A consequence of this has been that the strand from the supply package intermittently stops and starts, encouraging sloughing and breakage.

Prior art system designs, particularly constant torque storage feeder drive arrangements, have led to unresolved problems over wide ranges of operating conditions in the winding of strand from a supply package onto the drum of the feeder. Specifically, load changes encountered from strand package tensions and from frictional forces active in the storage feeder preclude operating at a speed generally matching the average loom withdrawal speed.

In practice with the present invention a strand feeding system between a strand supply and strand utility means such as a loom requiring strand to be fed at a first predetermined average value during operation of the utility means, i.e., a shuttleless loom is provided. The strand feeding system includes a drum arranged to receive the strand from the supply and have the strand wrapped around the drum by a flyer for temporary storage after which the strand is discharged to the loom. A balloon forms in the strand between the strand supply and the flyer during advance of the strand. A d-c variable speed motor is provided for rotating the flyer. An on-off circuit controls current flow to the motor. Speed control means are provided to establish a constant driven speed for the d-c motor in response to feedback data. Selectively adjustable voltage input means are coupled to the speed control means determining a strand feed rate from the supply which is slightly higher than the predetermined average value of strand demand by the loom. A detector serves to sense over-accumulation of strand on the drum and, in response thereto, operates the on-off circuit to interrupt current flow to the motor until said condition of over-accumulation is corrected. The on-off circuit is operated at a frequency and duration to maintain the balloon intact when current to the motor is interrupted.

Accordingly, it is a general object of this invention to resolve prior art problems of a strand storage feeder system having drum intermediate storage and tensioning control means by reducing significantly any sloughing or breakage of the strand resulting from changing drum motor drive speed or load.

This is achieved by controlling speed of operation of the strand storage feeder unit at a constant average value substantially correlated with required strand withdrawal rate, and by controlling speed variations in the strand feeding system to a frequency and duration such that the strand ballooning off the supply is maintained in its ballooning configuration.

SUMMARY OF THE INVENTION

Accordingly, the present invention to achieve this constant average drive speed for the flyer applying the strand to the drum of the feeder unit, provides a speed controlled d-c motor drive for the flyer which delivers strand to the intermediate storage drum of a storage feeder unit. Flyer drive speed is controlled through a feedback control sensing the motor speed and maintaining the actual drive speed from the motor at a constant value. A nominal speed correlating the strand consumption speed of the utilization device withdrawing the strand stored on the drum is set initially into the system.

The constant speed flyer drive approach of this invention changes the prior art drive control techniques from conventional variable speed to control the supply of strand on the drum and controls to keep constant the drive torque to the flyer. Accordingly, the contant flyer speed control in the presence of varying load inevitably encountered in these systems, produces variable torque drive to the flyer thereby reducing breakage and sloughing in the feeding of strand from the strand supply to the intermediate storage drum. Further, the frequent starts and stops of prior art strand storage feeder units are avoided by provision herein of a start-stop circuit for the feeder unit drive motor which operates at a frequency and duration to avoid a condition of strand over-accumulation on the feeder while maintaining the balloon in the strand intermediate the strand supply and the feeder unit.

DESCRIPTION OF DRAWINGS

In the accompanying drawings.

DESCRIPTION OF THE PREFERRED EMBODIMENT

Figure 1:
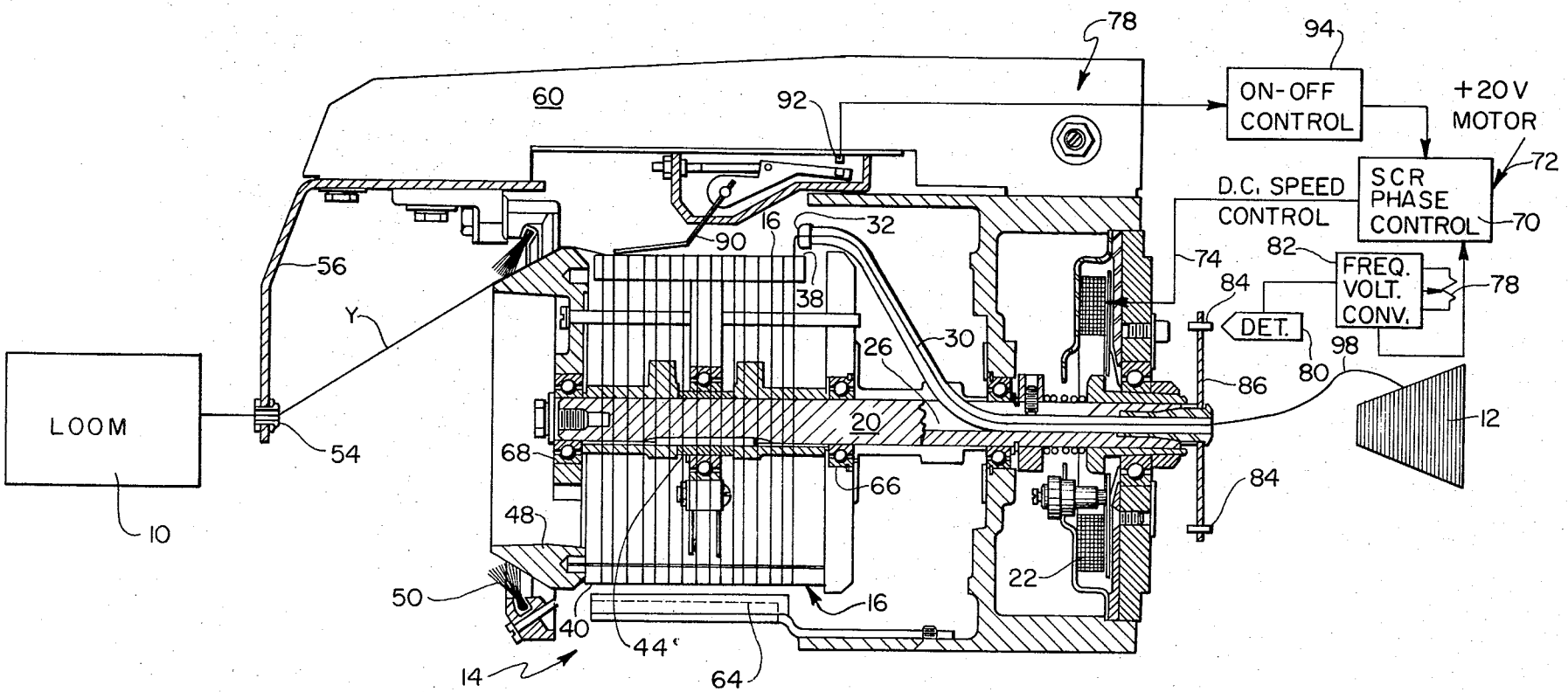
FIG. 1 is a diagrammatic system block diagram showing the inter-related elements for driving a strand delivery flyer at a constant speed.

As may be seen from the system arrangement of FIG. 1, a shuttleless loom 10 consumes increments of yarn Y withdrawn thereby from a supply package 12 in the conventional manner of a shuttleless loom at a substantially constant tension by action of an intermediate stationary drum strand storage feeder unit 14. Said storage feeder unti 14 can take a form and can include conventional details such as set forth in the above-mentioned Lawson patent. The feeder unit 14 of the present invention includes a stationary drum 16 upon which the yarn Y is wound from package 12 as the yarn advances to loom 10. The drum 16 of the storage feeder unit 14 is illustrated to indicate its arrangement in the system to receive yarn Y withdrawn from supply package 12 and discharge it at constant tension to the loom 10.

Unit 14 includes a main shaft 20 which is connected with a d-c electrical variable speed motor 22 to be driven thereby, the shaft 20, in effect, being arranged as the armature of the motor 22. Shaft 20 has a slot 26 milled therein to receive a crank-shaped yarn tube or flyer therein as illustrated in FIG. 1. Flyer 30 rotates in response to rotation of shaft 20. Flyer 30, being centerless, serves as a means for withdrawing the yarn from supply 12. The withdrawn yarn is guided through the flyer 30 and outwardly from its end 32 for wrapping about stationary drum 16 as shaft 20 and flyer 30 are rotated via motor 22. As the yarn is wound onto drum 16 by flyer 30 the yarn is advanced from a first end of drum 16, generally indicated by the numeral 38 to a second or remote end of drum 16, identified by the numeral 40, by means of a yarn advancing mechanism 44 more fully described in the afore-mentioned Lawson patent. From drum 40 the yarn is guided overend from the drum and drawn across a tapered nosepiece 48 mounted on shaft 20 and led beneath of stationary brush 50 bearing on the surface of nosepiece 48. Thus, brush 50 cooperates control means for the yarn being drawn off drum 16 by loom 10. The yarn is directed from nosepiece 48 through a guide 54, supported from a bracket 56 attached to a support frame 60 for the drum 16 and associated parts, and then conveyed to loom 10. Drum 16 is held stationary by means of a plurality of magnets 64 as yarn Y is wound thereon and withdrawn therefrom, the drum 16 being supported from shaft 20 on ball bearings 66 and 68 positioned at its opposite ends to isolate it from the rotational movement of the shaft 20. For further particulars of the unit 14 just described reference may be had to the prior cited Lawson patent.

A control system including the SCR phase control circuitry 70 establishes from the +20 volt d-c terminal 72 a varying d-c voltage at motor lead 74 for control of the motor speed as various load conditions are encountered, such as the afore-mentioned intermittent tension load of the supply yarn Y when pulled from package 12 or the friction of the sytem upon cold startup, thereby assuring under all operating conditions over long operating periods a matching of the speed of withdrawal of yarn Y from supply package 12 with consumption in loom 10.

In order to provide an adjustment for nominal motor speed to match closely that desired for feeding of yarn onto the drum 16 from supply package 12 by flyer 30 at the same average rate at which it is withdrawn by loom 10, an RPM voltage control means 78 is made available for selective manual adjustment. This serves to establish the running speed setting from flyer 30, which is thereafter maintained continuously constant by a feedback circuit comprising motor speed detector 80 and speed responsive voltage converter circuit 82. To further decrease system loading changes, detector 80 is preferably a contactless magnetic Hall-effect type detector that senses the passing poles of a set of six rotating magnets 84 arranged on disc 86 rotated by the motor 22. Accordingly, the "frequency to voltage" converter circuit 82 senses an appropriate frequency proportional to speed of motor 22 for conversion to a corresponding control voltage. This corrective control voltage, by medium of SCR phase control circuit 70 is established at a feedback magnitdue tending to keep the d-c motor speed constant at the speed set by RPM voltage control means 78 in the presence of changing load, voltage or other variable system conditions.

This constant speed operation of flyer 30 serves to prevent extended acceleration and deceleration phases that cause sloughing or breakage of the yarn Y being fed onto drum 16 from supply package 12.

For proper operation of intermediate storage flyer 30 the amount of yarn stored on drum 16 is sensed by a pivotable ferrous member 90. This sensing is accomplished without additional friction or load, as is the motor speed, by magnetic Hall-effect type detector 92 and operates whenever the supply of yarn on the drum becomes excessive by pivoting member 90 away from detector 92, or conversely. This actuates an on-off control circuit 94 for the d-c motor 22, to prevent overfilling of yarn on drum 16 for any reason such as stoppage of loom 10.

In operation therefore RPM voltage control means 78 is set so that the speed of flyer 30 is very close to, but very slightly exceeds, that required to match the withdrawal of yarn from the drum by loom 10. The on-off control 94 therefore need operate only for time intervals in the order of a few micro-seconds for the purpose of routinely correcting yarn overfill so that the necessary acceleration-deceleration phases caused by motor shut down and restart are minimized and are of very brief duration to avoid the corresponding tensioning and ballooning problems of withdrawal of yarn balloon 98 from supply package 12 onto the drum 16. Indeed, the frequency and duration of motor shut down periods are controlled so that the balloon 98 is maintained in essentially the same amplitudes during both current off and on phases while the loom is operating.

As can be therefore understood except for these deviations, in operation the drum 16 is driven at constant speed for continuously supplying yarn Y from supply package 12 onto the drum 16 at a rate generally matched with the average withdrawal rate at loom 10. Therefore, there is no substantial change of drum speed in the routine operation of the system.

Figure 2:
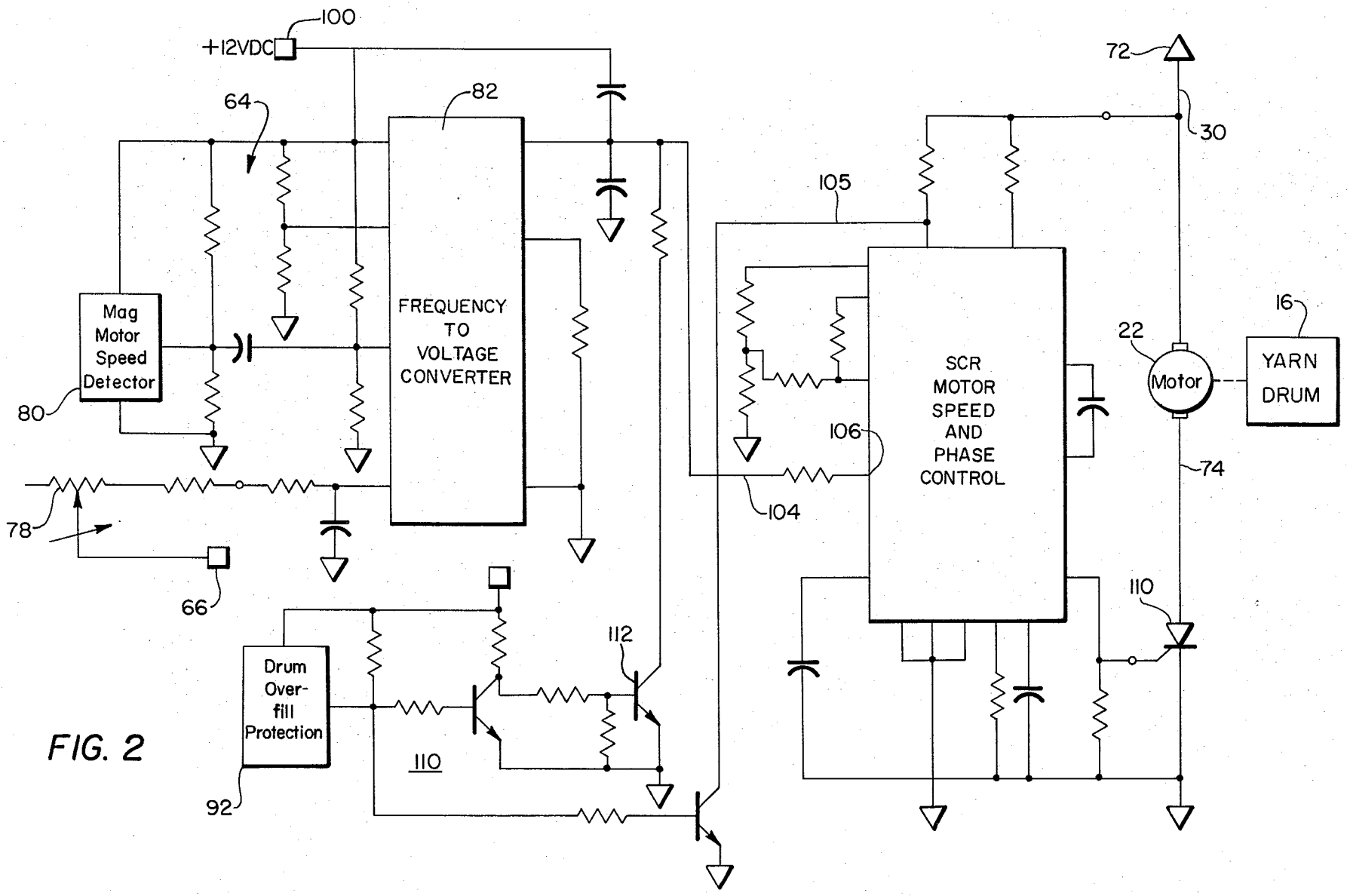
FIG. 2 is a schematic circuit diagram of a preferred control system embodiment of the invention.

The electrical control circuit configuration is set forth in the schematic circuit diagram of FIG. 2, wherein the same reference characters are used for comparison of similar system elements.

Magnetic motor speed detector 80 is a Hall effect device sensing the six magnetic poles per revolution of disc 86 in FIG. 1 to provide an appropriate frequency of impulses into the input network 64 for processing in the frequency to voltage converter circuit 82. Circuit operating voltage +12 volts d-c at terminal 100 as well as motor drive voltage +20 V d-c at terminal 72 is supplied from a suitable d-c supply not shown. All circuit parameters are shown and the various elements shown in block form are conventional commercially available units as hereinafter identified.

The resulting variable voltage output proportional to the actual flyer rotation speed will appear on lead 104 for input control to terminal 106 of the SCR motor speed control circuit 70 in a magnitude that will adjust the speed of motor 22 to compensate for changes of loading, voltage, etc., encountered in operation by control of the SCR device 110 in series with the motor 22 in the operating voltage supply path from terminal 72.

The motor speed signal derived from detector 80 is fed to a frequency-to-voltage converter circuit 82 which changes detector 80 output pulses to D.C. voltage. The level of this D.C. voltage is controlled by the voltage control means 78 which establishes the nominal running speed of motor 22 and is therefore set to match the rotation speed of the flyer 30 to coincide with the average consumption rate of yarn in the utility device as hereinbefore discussed.

The magnetic Hall effect type detector 92 which senses the storage level of yarn on the drum 16 controls the transistorized electronic switch circuit 110 which serves by way of transistor 112 to selectively establish a substantially ground voltage level at lead 105 to thereby prevent motor current flow through SCR device 110 and turn the motor off. In the preferred mode the motor is turned fully off so that the circuit is responsive to turn off the flyer in response to yarn feeding failures, etc., and in addition performs the function of monitoring the drum storage capacity of drum 16 to assure that it is not overfilled. Only the overfill capacity need be sensed for on-off drum control to perform the storage monitoring function if the RPM control 78 is set for a flyer speed very slightly greater than that necessary to feed the utility device. In this mode the number of changes of motor speed is minimized to extremely brief periods. This is in distinct contrast with the prior art necessity to repetitively change drum speed for relatively long time periods resulting in complete stops and, therefore, significantly increasing the opportunity for yarn balloon collapse and breakage.

Furthermore, this preferred embodiment has the additional advantages of providing effective controls that do not in any way load the drum or yarn drive paths to upset the delicate balances necessary for high speed trouble free yarn processing over long operating periods. This is effected by the electronic-magnetic sensing circuit embodiment, which furthermore is long-life without mechanical wear or electrical contact problems. Additionally, the sensing frequency parameters and electronic circuit time constants as established by the R-C networks therein are ideally suited for fast response to the intermittent instantaneous load conditions encountered in removing yarn from a bobbin or from system friction, etc., that cannot be followed by mechanically operated sensing means or mechanically moved control members.

Although the circuit technology itself is conventional outside this particular system, and may take other forms, the preferred embodiment which affords a combination of improved and co-acting operation features is constructed of the following commercially available component elements:

| | |
|---|---|
| Motor 22 | Model 12FP manufactured by Printed Motor Division Kollmorgen Corporation Glen Cove, New York |
| Hall Effect Detector 80 and 92 | Model UGN-3020T manufactured by Sprague Electric Company Concord, New Hampshire |
| Frequency-to Voltage Converter Integrated Circuit | Part No. RC4151NB manufactured by Raytheon, Semi-Conductor Division Mountain View, California |
| SCR Motor Speed Control Integrated Circuit | Model No. L120B1 manufactured by SGS - Ates Semiconductor Corporation Newtonville, Massachusetts |

The following data discloses the time required to achieve decay of balloon 98 in operation with a yarn storage feeder of the type described herein. In the tests from which the data was derived the drum of the yarn storage feeder was 16 inches in circumference and 10 grams tension was applied to the yarn proximate to the input end of the flyer to achieve prompt engagement of the yarn on drum 16.

| SPEED/ FLYER/RPM | PKG. DIA. | YARN COUNT | BALLOON DECAY PERIOD |
|---|---|---|---|
| 1200 Rpm | 8" | 20/1 Cot/Poly | 41 Milli Sec |
| 1950 Rpm | 8" | 20/1 Cot/Poly | 266 Milli Sec |
| 1950 Rpm | 8" | 20/1 Cot/Poly | 291 Milli Sec |
| 1950 Rpm | 5" | 4.03/1 Acrylic | 291 Milli Sec |
| 1950 Rpm | 5" | 4.03/1 Acrylic | 316 Milli Sec |
| 1950 Rpm | 7" | 5.19/1 Cotton | 333 Milli Sec |
| 1950 Rpm | 7" | 5.19/1 Cotton | 324 Milli Sec |

-continued

| SPEED/ FLYER/RPM | PKG. DIA. | YARN COUNT | BALLOON DECAY PERIOD |
|---|---|---|---|
| 3000 Rpm | 7" | 5.19/1 Cotton | 365 Milli Sec |
| 3000 Rpm | 7" | 5.19/1 Cotton | 373 Milli Sec |
| 3000 Rpm | 5" | 4.03/1 Acrylic | 341 Milli Sec |
| 3000 Rpm | 5" | 4.03/1 Acrylic | 349 Milli Sec |
| 3700 Rpm | 5" | 4.03/1 Acrylic | 399 Milli Sec |
| 3700 Rpm | 5" | 4.03/1 Acrylic | 391 Milli Sec |

It can be seen from the foregoing data that the period of time required to achieve total balloon decay in operation with the yarn storage feeder ranged from 41 milli-seconds at 1200 R.P.M. of the flyer to 391 milli-seconds at 3700 R.P.M. of the same flyer. The balloon decay periods recited in the above data correspond to the times required to halt rotation of shaft 20 and flyer 30. Flyer speed is readily adjustable via the disclosed circuitry so that its overall yarn withdrawal rate nearly matches utility means consumption rate. Thus, the interruption of power to motor 22 is in the order of a few milli-seconds, far less than the times shown above for effecting balloon decay. It follows that in practice with the present invention the amplitude of the balloon formed in the strand intermediate the supply 12 and the input end of flyer 30 remains substantially constant throughout the operation of the strand storage feeder unit 14 and companion loom 10.

It is clear therefore from the foregoing description of the invention and a preferred embodiment thereof that there is provided a new and improved system for controlling the tension and feeding conditions of yarn from a supply source to utility means such as a loom. By controlling the rotational speed of the yarn delivery flyer of the intermediate storage device to achieve a constant speed matching the average continuous consumption rate of yarn by the loom the occurrence rate of acceleration-deceleration drum phases which tend to introduce sloughing or breakage of yarn is significantly decreased over prior art systems incorporating drum speed control. Thus, the present invention affords a more reliable long term yarn feeding system for controlling yarn tension to a loom while reducing problems of sloughing and breaking over a large range of yarn sizes and feed speeds.

What is claimed is:

1. A strand feeding system between a strand supply and utility means such as a textile machine requiring strand to be fed at a first predetermined average rate during operation of the utility means comprising, a feeding device arranged to receive said strand from said supply and have the strand wrapped thereon for discharge thereafter to said utility means, a balloon of strand being formed in the zone intermediate the strand supply and the feeding device during advance of the strand to the feeding device, a variable speed drive motor for operating said feeding device to withdraw said strand from said supply, an on-off circuit for controlling current flow to said motor to prevent excess accumulation of strand on said drum, speed control means programmed to establish a constant driven speed of said motor in response to input feedback data, selectively adjustable input means coupled to said speed control means to advance said strand from said supply to said feeding device at a second predetermined average rate which is slightly higher than said first predetermined average rate, and detector means for sensing accumulation of strand on said feeding device and operable to activate said on-off circuit to interrupt current flow to said motor when the strand accumulation on said feeding device exceeds a preselected amount, said on-off circuit being operated at a frequency and duration to maintain said balloon during intervals when current flow to said motor is off.

2. A strand feeding system as set forth in claim 1 wherein said feeding device includes a stationary drum on which said strand is wound.

3. A strand feeding device as set forth in claim 1 wherein said drive motor is a d.c. motor.

4. A strand feeding system as set forth in claim 2 wherein the interval when the motor is off is less than time required to arrest operation of said feeding device to wind said strand onto said drum.

5. A strand feeding system as set forth in claim 1 wherein said drive motor is independent of said utility means.

6. A method for controlling strand delivery between a strand supply and utility means requiring said strand to be fed at a first substantially constant predetermined average rate comprising the steps of, operating a strand feeding device through electric drive means to advance the strand from said strand supply and wind said strand on said feeding device for discharge thereafter to said utility means, forming a balloon in said advancing strand intermediate said strand supply and said feeding device, controlling said drive means to operate said feeding device to withdraw said strand from said strand supply at a second substantially constant predetermined average rate which is slightly higher than said first predetermined average rate, detecting the accumulation of strand on said feeding device, interrupting the current flow to said drive means when the amount of strand on said feeding device exceeds a predetermined amount, and controlling the frequency and duration of said interruptions to maintain the balloon in said strand when the current flow is interrupted.

7. The method as set forth in claim 6 including the step of maintaining the feeding device winding rate constant by feedback regulating means responsive to the actual winding rate of said feeding device.

8. The method as set forth in claim 7 wherein the step of operating the feeding device at a substantially constant winding rate includes providing a d-c variable speed motor as the drive means, and including the step of controlling the voltage supplied to said d-c motor to attain said constant winding rate.

9. The method as set forth in claim 6 wherein said feeding device includes a drum upon which said strand is wound, and including the step of maintaining said drum against rotation.

* * * * *